United States Patent [19]

Branson et al.

[11] 3,979,103

[45] Sept. 7, 1976

[54] FUEL CONTROL SYSTEM AND CONTROL DEVICE THEREFOR OR THE LIKE

[75] Inventors: Charles D. Branson; Roy C. Demi, both of Greensburg, Pa.

[73] Assignee: Robertshaw Controls Company, Richmond, Va.

[22] Filed: Apr. 23, 1975

[21] Appl. No.: 570,866

Related U.S. Application Data

[60] Division of Ser. No. 530,605, Dec. 9, 1974, which is a continuation-in-part of Ser. No. 443,783, Feb. 19, 1974, abandoned, which is a continuation-in-part of Ser. No. 380,389, July 18, 1973, abandoned.

[52] U.S. Cl. ..... 251/97; 236/15 A

[51] Int. Cl.[2] ..... F16K 35/02

[58] Field of Search ..... 236/15 A, 99; 251/95–97

[56] References Cited

UNITED STATES PATENTS

| | | | |
|---|---|---|---|
| 1,617,886 | 2/1927 | Wild | 236/15 A |
| 3,123,296 | 3/1964 | Wantz et al. | 236/99 |
| 3,693,874 | 9/1972 | Fox | 236/15 A |

*Primary Examiner*—William E. Wayner

*Attorney, Agent, or Firm*—Candor, Candor & Tassone

[57] ABSTRACT

A fuel control device having a passage therethrough for interconnecting a fuel source with a main burner and having a poppet valve arrangement that is directly manually operated for opening and closing the passage so as to control the flow of fuel from the source to the main burner, the poppet valve arrangement having a poppet valve member that is moved relative to its valve seat upon the manual manipulation of a selector of the control device. The selector locks with the control device in the "off" position and the control device has a long and gradual cam surface to permit the selector to be moved to its locked "off" position without excessive "feel".

2 Claims, 11 Drawing Figures

FUEL CONTROL SYSTEM AND CONTROL DEVICE THEREFOR OR THE LIKE

This is a division of application Ser. No. 530,605, filed Dec. 9, 1974, now U.S. Published Patent Application No. B530,605 which is Continuation-in-Part of its parent copending application, Ser. No. 443,783, filed Feb. 19, 1974, now abandoned and which, in turn, is a Continuation-in-Part of its parent copending application, Ser. No. 380,389, filed July 18, 1973, and now abandoned in favor of its said copending Continuation-in-Part application.

This invention relates to an improved fuel control system for a fuel burning apparatus, such as a cooking apparatus or the like and to an improved control device for such a fuel control system of the like.

It is well known to provide a fuel control system for a fluid fuel burning apparatus, such as a cooking apparatus or the like, wherein a passage defining means is provided between a source of fuel and the main burner with the passage defining means having a pair of control devices disposed therein in series relation with the first control device having means for manually opening the passage defining means when the selector of the first control device is moved from an "off" position thereof toward an "on" position thereof. The first control device also has means for thermostatically controlling the flow of fuel to the passage means downstream from the main "on-off" valve means thereof while the second control device has its valve means moved from a closed position thereof to an open position thereof when the second control device senses the presence of a large heater flame at a pilot burner means that is disposed adjacent the main burner, the heater pilot being controlled by the thermostatically operated valve means of the first control device.

In particular, the selector of the first control device sets the thermostatically operated valve means thereof to thermostatically control the flow of fuel to the heater pilot means so that when the output temperature effect of the main burner falls below the selected temperature of the selector of the first control device, the thermostatic valve means of the first control device opens and allows not only fuel to flow through the passage defining means to the second control device, but also allows fuel to flow to the heater pilot to form a large heater flame that is detected by the second control device so that the control device will open and pass the main flow of fuel on to the main burner to be ignited by the pilot burner means. When the output temperature effect of the main burner exceeds the set temperature setting of the selector of the first control device, the thermostatically operated valve means of the first control device closes and thus prevents fuel from flowing to the heater pilot means so that the heater flame ceases to exist and causes the valve means of the second control device to close and block the passage leading to the main burner.

In this manner, the main burner means can be caused to be cycled on and off to tend to maintain the output temperature effect thereof at the temperature selected by the selector of the first control device.

Such fuel control systems are fully disclosed in the U.S. Pat. to Wantz et al., Nos. 3,132,803 and No. 3,167,250.

However, it has been found according to the teachings of this invention, that in view of the fact that the pressures of gaseous fuels being supplied through pipe lines to be subsequently piped to the ultimate consumer is increasing in order to supply a greater number of users and over greater distances from sources thereof, a series of pressure regulators must be utilized not only in the utility lines, but also in the consumer's building in order to step down the pressure of such high pressure fuel to a useable pressure level for the desired fuel burning apparatus.

Should such step-down fuel pressure regulator means fail so that a relatively high pressure fuel is being delivered to a particular fuel control system of the above type, the main on-off valve member of the first control device must withstand such adverse pressures in order to prevent such high pressure fuel from leaking therethrough and into the fuel control system to create a hazardous condition.

Accordingly, it is a feature of this invention to provide an improved control device of the above type having an improved on-off valve means therefor that is believed will tend to withstand such high adverse fuel pressure situations and thereby not permit the aforementioned hazardous fuel leaking situation.

Another feature of this invention is to provide a fuel control system utilizing such a control device or the like.

In particular, one embodiment of the improved control device of this invention has a poppet valve member providing the main on-off valve means thereof with such poppet valve member being directly movable between its open and closed positions by the selector means of the control device being moved between its off position and a certain on position thereof, such selector means also setting a thermostatically operated valve means of such control device. The selector means has latch means for latching the selector means in its off position when the poppet valve means is in its closed position, the control device having latch means cooperable with the latch means of the selector means for latching the selector means in the off position thereof. The selector means is axially movable to clear the latch means of the selector means from the latch means of the control device, the selector means being rotatable in the unlatched condition thereof to operate the poppet valve means. The latch means of the control device comprises a cam surface having a drop-off, the latch means of the selector means comprising a tang that cooperates with the drop-off of the cam surface to latch the selector means in the off position thereof. The cam surface is relatively long and gradual to permit the tang to ride up the same to the drop-off thereof without excessive feel of axial movement of the selector means as the selector means is moved to the off position thereof.

Accordingly, it is an object of this invention to provide an improved fuel control device having one or more of the novel features set forth above or hereinafter shown or described.

Another object of this invention is to provide a fuel control system utilizing such a control device or the like.

Other objects, uses and advantages of this invention are apparent from a reading of this description which proceeds with reference to the accompanying drawings forming a part thereof and wherein.

Figure 1:
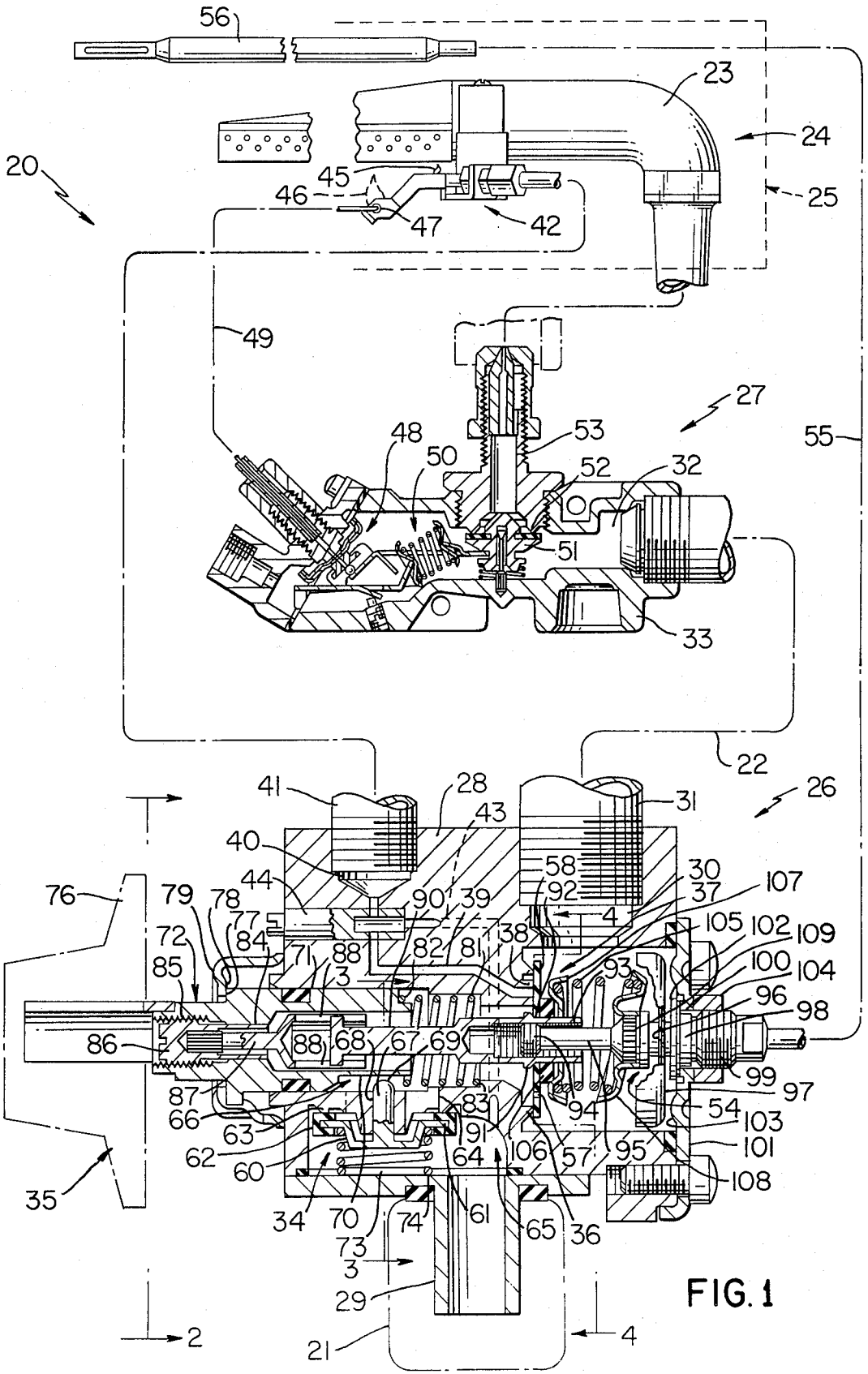
FIG. 1 is a schematic view, partially in cross section, illustrating the improved fuel control device and system of this invention.
Figure 2:
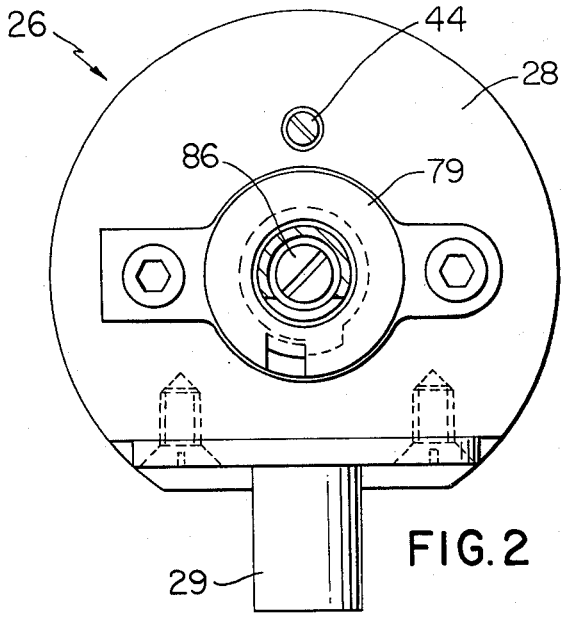
FIG. 2 is a fragmentary, cross-sectional view taken on line 2—2 of FIG. 1.
Figure 3:
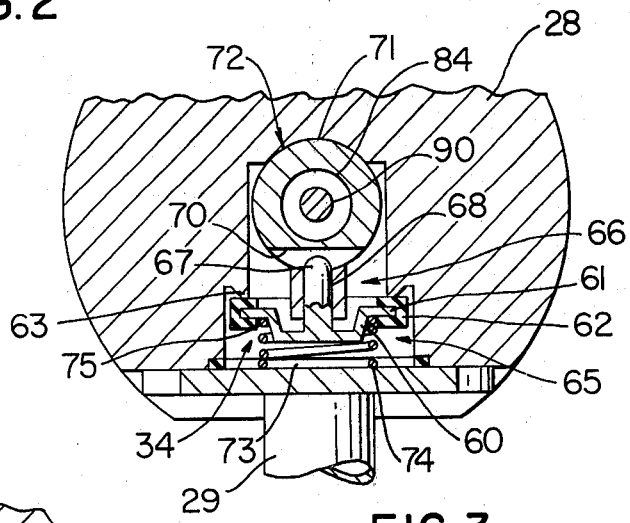
FIG. 3 is a fragmentary, cross-sectional view taken on line 3—3 of FIG. 1.

While the various features of this invention are hereinafter described and ilustrated as being particularly adapted to provide a control device for a fuel burning cooking apparatus, it is to be understood that the various features of this invention can be utilized singly or in any combination thereof to provide control devices for other apparatus as desired.

Therefore, this invention is not to be limited to only the embodiments illustrated in the drawings, because the drawings are merely utilized to illustrate some of the wide variety of the uses of this invention.

Referring now to FIG. 1, the improved fuel control system of this invention is generally indicated by the reference numeral 20 and comprises a fuel source manifold 21 being interconnected by passage defining means 22 to a main burner 23 disposed in an oven chamber 24 of a cooking apparatus that is indicated by dash lines and generally indicated by the reference numeral 25, the passage defining means 22 having a pair of control devices disposed therein in series relation and respectively being generally indicated by the reference numerals 26 and 27.

The first fuel control device 26 comprises a housing means 28 having an inlet 29 adapted to be disposed in fluid communication with the fuel supply manifold 21 and an outlet 30 adapted to be interconnected to a conduit means 31 that forms part of the passage defining means 22 and leads to an inlet 32 of a housing means 33 of the second fuel control device 27.

The first fuel control device 26 has a main on-off valve means that is generally indicated by the reference numeral 34 in FIG. 1 and is adapted to be directly opened and closed by a selector means 35 of the first fuel control device 26 in a manner hereinafter described. The valve means 34 when moved to an open position will supply fuel from the manifold 21 to a valve seat 36 of the housing 28 that is opened and closed by thermostatically operated valve means that is generally indicated by the reference numeral 37.

The thermostatically operated valve means 37 when opening the valve seat 36, permits the fuel to flow from the opened on-off main valve means 34 out through the outlet 30 and thus to the inlet 32 of the second fuel control device 27. The opening of the thermostatic valve means 37 also permits fuel to flow through a second inner valve seat 38 of the fuel control device 26 that leads by a passage means 39 in the housing means 28 to an outlet 40 that is adapted to be coupled by a conduit means 41 to a pilot burner means of the main burner 23, the pilot burner means being generally indicated by the reference numeral 42 and comprising a "dual-rate" pilot burner means.

In particular, the pilot burner means 42 is adapted to be continuously fed a flow of fuel at a small rate from the manifold 21 through a passage means 43 of the control device 26 that bypasses the main on-off valve means 34 thereof and leads to the outlet 40 through an adjusting key 44 so that the small amount of fuel that is continuously fed to the pilot means 42 can continuously burn at the pilot burner means 42 to provide a small standby flame 45 even when the selector means 35 is in an off position and the cooking apparatus 25 is not being utilized.

However, when the thermostatically operated valve means 37 opens in a manner hereinafter described, additional fuel is adapted to flow to the outlet 40 of the control device 26 through the opened inner valve seat 38 and interconnecting passage 39 so that the additional fuel flowing to the pilot burner means 42 will create a large heater flame 46 at the pilot burner means 42 that is adapted to be detected by a flame sensor or bulb 47 carried by the pilot burner means 42 and being interconnected to an expandible, contractible member 48 in the housing 33 of the control device 27 by a conduit means or capillary tube 49.

The expandible and contractible element 48 of the control device 27 is interconnected by suitable lever and spring means 50 to a poppet valve member 51 that is normally seated against a valve seat 52 of the housing 33 and thereby blocking the inlet 32 of the housing 33 from an outlet 53 thereof so as to prevent fuel from flowing through the passage defining means 22 to the main burner 23 as the outlet 53 is in fluid communication with the main burner 23.

However, the element 48 expands when the detector 47 is sensing the large heater flame 46 at the pilot burner means 42 and the expansion of the power element 48 causes the lever and spring arrangement 50 to move and hold the poppet valve member 51 from its closed position to a fully open position whereby fuel from the inlet 32 in the control device 27 is now permitted to flow to the outlet 53 thereof and, thus, to the main burner 23 to be ignited by the pilot burner means 42.

Thus, as long as the thermostatically operated valve means 37 of the first fuel control device 26 is in an open condition, not only is fuel supplied from the manifold 21 to the second control device 27, but also fuel is supplied to the pilot burner means 42 through the opened valve seat 38 to continuously produce the large heater flame 46 so that the valve member 51 of the fuel control device 27 will remain in an open condition and pass the fuel on to the main burner 23.

However, the thermostatically operated valve means 37 of the fuel control device 26 has an expandible and contractible power element 54 that controls the opening and closing movements thereof, the power element having its interior interconnected by a conduit means 55 to a temperature sensing bulb 56 disposed in the oven chamber 24 and thereby sensing the output temperature effect of the main burner 23.

Thus, when the temperature in the oven chamber 24 exceeds the temperature setting of the selector means 35 of the fuel control device 26, the thermostatic valve means 37 is closed by the expanded power element 54 to not only block the main flow of fuel from the manifold 21 into the conduit 31, but also to block the flow of fuel into the passage 39 of the fuel control device 26 so that the heater flame 46 will no longer be created at the pilot burner means 42. Since the heater flame 46 no longer appears at the pilot burner means 42, the power element 48 of the control device 27 collapses and through the lever and spring arrangement 50 causes the valve member 51 to close against the valve seat 52.

However, due to a thermal lag created by the delay in the time that it takes the power element 48 of the control device 27 to collapse and cause closing of the valve member 51 from the time the heater flame 46 ceases to exist because the thermostatically operated valve means 37 has closed, there is a likelihood that the fuel remaining in the conduit 31 does not have a sufficient pressure to pass out of the burner means 23 and be burned externally thereof so that a flash back situation could exist when the valve means 37 is closed and the control device 27 has its valve member 51 remaining in its open condition due to the thermal lag in the time it takes the power element 48 to collapse.

Accordingly, a bypass passage or orifice 57 is provided through a valve disc 58 of the thermostatically operated valve means 37 to supply sufficient fuel to the outlet 30 to support combustion at the main burner means 23 whenever the valve disc 58 is fully seated against the valve seat 36 and the fuel control device 27 remains open because of the thermal lag in the closing thereof so that the adverse flash back situation will not exist.

Thus, it can be seen that the fuel control device 26 when set in an on position thereof not only opens the main on-off valve means 34 thereof, but also sets the desired output temperature effect of the main burner means 23 so that the main burner 23 can be cycled on and off in the manner previously described to tend to maintain the output temperature effect in the oven chamber 24 at the output temperature setting of the selector 35 of the control device 26.

Since the details and theory of operation of the control device 27 and dual rate pilot burner 42 are fully set forth in the U.S. Pat. to Branson et al., No. 3,367,572 and the U.S. Pat. to Riehl, No. 3,405,999, no detailed explanation of the parts and operation of the fuel control device 27 and dual rate pilot burner means 42 is deemed necessary as any desired information thereon can be obtained from a reading of the aforementioned patents to Branson et al. and Riehl.

However, the details and operation of the fuel control device 26 of this invention will now be described.

The main on-off valve means 34 of the control device 26 comprises a poppet valve member 60 that is substantially cup-shaped and has an outer peripheral flange 61 at the open end thereof covered by an annular resilient member 62 adapted to fully seat on an annular valve seat 63 formed in the housing means 28 and surrounding a plurality of openings 64 that lead from a chamber 65 formed in the housing means 28 to a stepped cylindrical chamber 66 formed in the housing means 28, the chamber 65 being interconnected to the inlet 29 while the chamber 66 leads to the annular valve seat 36.

The poppet valve member 60 has a stem 67 passing thrugh a guide opening 68 in the housing 28 in such a manner that a rounded end 69 of the stem 67 is disposed within the chamber 66 and within the path of movement of a cam surface 70 formed on a cylindrical part 71 of a shaft means that is generally indicated by the reference numeral 72 and forming a part of the selector means 35 of the fuel control device 26.

A compression spring 73 is disposed in the chamber 65 and has one end 74 bearing against the housing means 28 and the other end 75 thereof bearing against the poppet valve member 60 to tend to hold the poppet valve member 60 in its closed position against the valve seat 63.

It can also be seen that the fuel pressure being fed from the source 21 into the chamber 65 of the housing means 28 also acts against the valve member 60 in a manner to hold the valve member 60 in its closed position against the valve seat 63.

Thus, when the selector means 35 is in its off position, the fuel pressure from the source 21, as well as the compression spring 73, acts to hold the valve member 60 in its closed position against the valve seat 63 so that even though the usual pressure of the fuel in the manifold 21 should increase through a malfunction in a pressure regulator or the like upstream from the manifold 21, the valve member 60 will not be blown off the valve seat 63 but will be further urged against the valve seat 63 so as to prevent such fuel from entering into the control system 20 and creating an adverse situation as previously described.

The shaft means 72 has the shaft part 71 thereof interconnected to a suitable control knob 76 of the selector means 35 and has a shoulder 77 thereof normally urged toward and against the inside surface 78 of a casing member 79 secured to the housing means 28 in alignment with the cylindrical bore or chamber 66 whereby the shaft part 71 closes the left-hand side of the chamber 66. If desired, suitable sealing means 80 can be provided on the shaft part 71 to fluid seal the left-hand part of the chamber 66 as illustrated in FIG. 1. The shoulder 77 of the shaft part 71 is urged against the surface 78 of the casing 79 by a compression spring 81 disposed within the right-hand part of the chamber 66 and having one end 82 bearing against the shaft part 71 and the other end 83 thereof bearing against the housing means 28.

The shaft part 71 has a stepped bore 84 passing therethrough with the bore 84 having its left-hand part 85 internally threaded to receive a threaded adjusting member 86 that carries a member 87 provided with a pair of slots 88 in the right-hand end thereof and which respectively receive opposed outwardly directed tangs on the left-hand end of a shaft part 90 that has a conical outwardly extending abutment 91 thereon. The shaft part 90 is adapted to have its right-hand end in FIG. 1 extend through an opening 92 in the valve disc 58 of the thermostatically operated valve means 37 with the outwardly directed conical abutment 91 being larger than the opening 92 in the valve disc 58 to carry the valve disc 58 therewith in a manner hereinafter described.

The right-hand end of the shaft part 90 is interrupted by a threaded bore 93 which receives a threaded end 94 of a stem member 95 that is carried on a cup-shaped movable wall 96 of the power element 54 which has another cup-shaped wall 97 fixed to a pin means 98 to be carried thereby.

The pin means 98 has a threaded portion 99 adapted to pass through an opening 100 in an end plate 101 of the housing means 28 while a disc-like part 102 of the pin 98 is adapted to abut against the inside surface 103 of the plate 101 in the manner illustrated in FIG. 1. With the plate 102 of the pin 98 abutting against the end plate 101, a lock nut 104 can be threaded on the threaded part 99 of the pin 98 to hold the power element 54 in the position illustrated in FIG. 1, the pin 98 fluidly interconnecting the capillary tube 55 to the spacing between the two cup-shaped members or walls 96 and 97 that have the outer peripheries of the open ends thereof sealed together in a conventional manner.

While the valve disc 58 is loosely disposed on the shaft part 90, the same is either urged toward or against the valve seat 36 or against the conical abutment 91 of the shaft part 90 by a compression spring 105.

In particular, a flexible washer-like member 106 is telescoped onto the shaft member 90 and is disposed against the right side of the disc 58 in FIG. 1. Thereafter, spring retainer 107 is telescoped onto the shaft part 90 against the washer-like member 106.

A spring retainer 108 is disposed on an enlarged knurled part 109 of the shaft 95 so as to fix the same from rotation thereon, the spring retainer 108 being angled relative to the longitudinal and rotational axis of the shaft means 72 so as to cause the compression spring 105 disposed between the spring retainers 107 and 108 to cause tilting of the valve member 58 during its initial opening movement from the valve seat 36 at the same angle relative thereto each time the valve disc 58 initially opens the valve seat 36 as will be apparent hereinafter as well as each time the valve disc 58 closes the valve seat 36.

Figure 4:
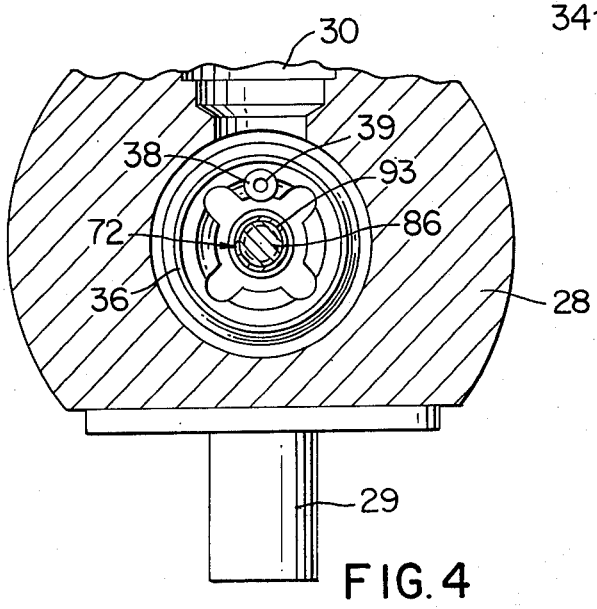
FIG. 4 is a fragmentary, cross-sectional view taken on line 4—4 of FIG. 1.

Rotation of the shaft means 72 by the knob 76 to the off position illustrated in FIG. 1 causes the shaft part 71 and part 87 interconnected thereto to rotate in unison and thereby rotate the shaft part 90 and cause the same to rotate relative to the threaded end 94 of the pin 95 and thereby axially move to the left relative thereto by unthreading on the end 94 whereby the abutment 91 of the part 90 moves to the left in FIG. 1 a sufficient distance that even though the power element 54 is in its completely collapsed condition, the spring 105 will maintain the valve disc 58 fully seated against the valve seat 36 so as to close not only the valve seat 36, but also close the small valve seat 38 that is disposed inboard of the main valve seat 36 in the manner illustrated in FIG. 4.

Figure 5:
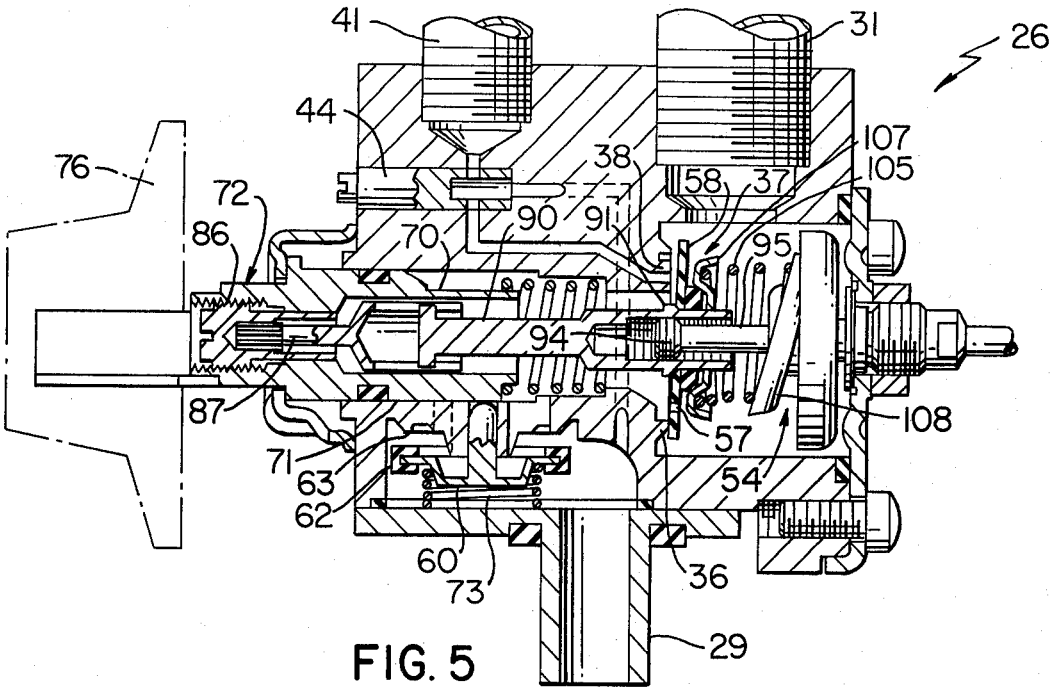
FIG. 5 is a fragmentary view similar to FIG. 1 and illustrates the control device of this invention as the same has its thermostatically operated valve means initially opening.

However, when the shaft means 72 is rotated by the knob 76 to an on position thereof, such rotation of the shaft part 71 not only causes the cam means 70 thereof to operate against the rounded end 69 of the poppet valve member 60 to move the same to a fully open condition thereof as illustrated in FIG. 5, but also such rotation of the shaft part 71 causes the member 90 to thread onto the member 94 and be moved to the right in FIG. 1 to abut and move the valve member 58 therewith so that the valve seat 36 will be fully opened as long as the temperature in the oven chamber 24 is not at the temperature setting of the selector means 35.

However, when the power element 54 expands as the temperature in the oven chamber 24 increases, the power element 54 will expand in such a manner that the same will move the valve disc 58 fully against the valve seat 36 when the output temperature effect in the oven chamber 24 is substantially at or slightly above the set temperature setting of the selector means 35.

From the above, it can be seen that the control device 26 can be formed in a relatively simple manner to provide a positively closed main on-off poppet valve member and a thermostatically controlled valve means 37 to be utilized in the fuel control system 20 in a manner now to be described.

When the operator desires to utilize the cooking apparatus 25, the knob 76 of the selector means 35 is moved from the off position thereof to the desired temperature setting position thereof. As the shaft means 72 is being rotated by the knob 76, the cam surface 70 of the shaft part 71 acts against the stem 67 of the poppet valve member 60 to move the same to an open position as illustrated in FIG. 5 and hold the same in such open position regardless of where the selector means 35 is subsequently set in any of its oven on positions.

If desired, the poppet valve member 60 and the shaft part 71 can be formed of steel to reduce wear therebetween for long life, such cam arrangement reducing or eliminating the need for lubrication in the field as is required by prior known main on-off valve arrangements.

Also, such opening of the poppet valve means 34 causes an initial full flow of fuel through the valve seat 63 as the valve member 60 tends to open with a snap movement once the same is initially cracked open by the cam 70 of the shaft means 72 and because the poppet valve means 34 is disposed in the inlet without having a restricted or torsions flow path for the fuel to pass through before the same reaches the thermostatically operated valve means 37.

As previously stated, such rotation of the shaft means 72 causes the member 90 to be more threaded on the threaded end 94 of the pin 95 to a certain position so that the valve disc 58 is held away from the valve seat 36 by the abutment means 91 in opposition to force of the spring 105 and thereby permits fuel to flow from the fuel source manifold 21 through the open poppet valve means 37 to the outlet 30 and, thus, to the safety valve control device 27. Fuel also flows through the opened valve seat 38 to the pilot burner means 42 to create the heater flame 46. When the heater flame 46 is created, the same is detected by the detector 47 and the poppet valve member 51 of the control device 27 is moved to its open position whereby fuel is now adapted to flow to the main burner 23 and be ignited by the pilot burner means 42. The thus operating burner means 23 begins to heat up the oven chamber 24 to the temperature selected by the selector means 35.

When the temperature in the oven chamber 24 reaches the temperature setting of the selector means 35 or is slightly above the same, the power element 54 has expanded in such a manner that the same has caused the valve disc 58 to fully seat against the valve seat 36 and thereby close off the flow of fuel not only to the outlet 30, but also the the valve seat 38 that leads to the pilot burner means 42. In this manner, the heater flame 46 ceases to exist and the control device 27 will subsequently close thereby terminating any flow of fuel to the main burner means 23. As previously stated, during the delay in time from the time the valve disc 58 is fully seated against the valve seat 36 and the valve member 51 of the control device 27 has fully seated against the valve seat 52, the opening 57 through the valve disc 58 supplies sufficient fuel to the main burner means 23 to support combustion at the main burner means 23 so that no adverse flash back situation can exist.

The valve disc 58 remains seated against the valve seat 36 until the output temperature effect in the oven cavity 24 falls below the selected temperature setting thereof whereby the power element 54 is collapsing in such a manner that the same is pulling the shaft part 90 to the right in FIGS. 1 and 5 in such a manner that the conical abutment 91 thereof engages against the valve disc 58 to pull the same to the right therewith. However, because the compression spring 105 has one side held at an angle by the angled spring retainer 108 whereby the spring 105 has its most compressed portion disposed 180° from the valve seat 36 with a tilting action as illustrated in FIG. 5 so that each time the valve disc 58 is opened relative to the valve seat 36, the same will open with the same angle of tilt so that the flow of fuel that is adapted to pass into the thus open valve seat 38 to cause the heater flame 46 will always occur when the valve disc 58 has been initially cracked open relative to the valve seat 36 at exactly the same position in its opening movement so that proper calibration of the control device 26 an be maintained.

For example, should the valve member 58 be permitted to tilt at any random angle relative to the valve seat 38 during the initial opening of the valve member 58 relative to the valve seat 36, it will require the collapsing of the power element 54 to be at a greater degree of collapse thereof, if the valve member 38 should tilt 180° from the tilt angle illustrated in FIG. 5, before the valve member 58 will permit sufficient fuel to flow into the valve seat 38 to produce the heater flame 46 when the valve member 58 is permitted to tilt 180° from the valve seat 38 in the manner illustrated in FIG. 5.

Thus, for each temperature setting of the selector means 35, a deviation in the maintained temperature in the oven 24 would take place if the valve member 58 were not caused to open with a tilt relative to the valve seat 36 at exactly the same angle each time the same is cycled by the power element 54 to an open position thereof.

Accordingly, while the spring retainer 108 is illustrated as providing the greatest compression to the spring 105 at a position 180° from the valve seat 38, it is to be understood that the spring retainer 108 could be utilized to provide for the disc 58 to tilt 90° relative to the valve seat 38 or even at the valve seat 38 if desired, the important feature being that the tilt of the valve member 58 in its opening and closing movement relative to the valve seat 36 and, thus, relative to the valve seat 38 always to be the same for that particular control device 26 so that the particular control device can be properly calibrated in a manner now to be described.

In the embodiment of the control device 26, it can be seen that by adjusting the threaded relation of the adjusting member 86 in the shaft part 71, the position of the abutment means 91 relative to the power element 54 when the bulb 56 is sensing a certain temperature can be set so that the thermostatically operated valve means 37 will operate to produce the desired output temperature effect in the oven 24 that is selected by the selector means 35 by having the valve disc 58 open when the bulb 56 is sensing a temperature just below the selected temperature of the selector means 35 of the control device 26.

Figure 6:
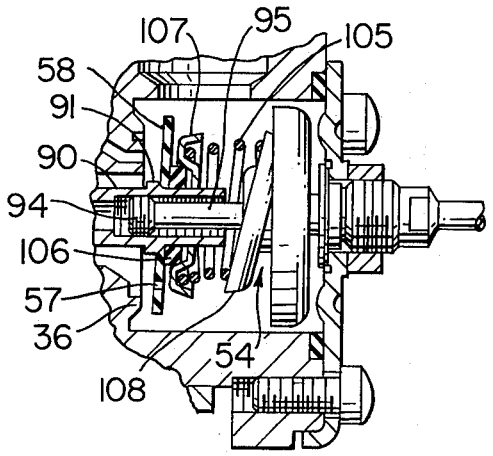
FIG. 6 is a partial view similar to FIG. 5 and illustrates the thermostatically operated valve means of the control device of this invention in a fully open position thereof.
Figure 7:
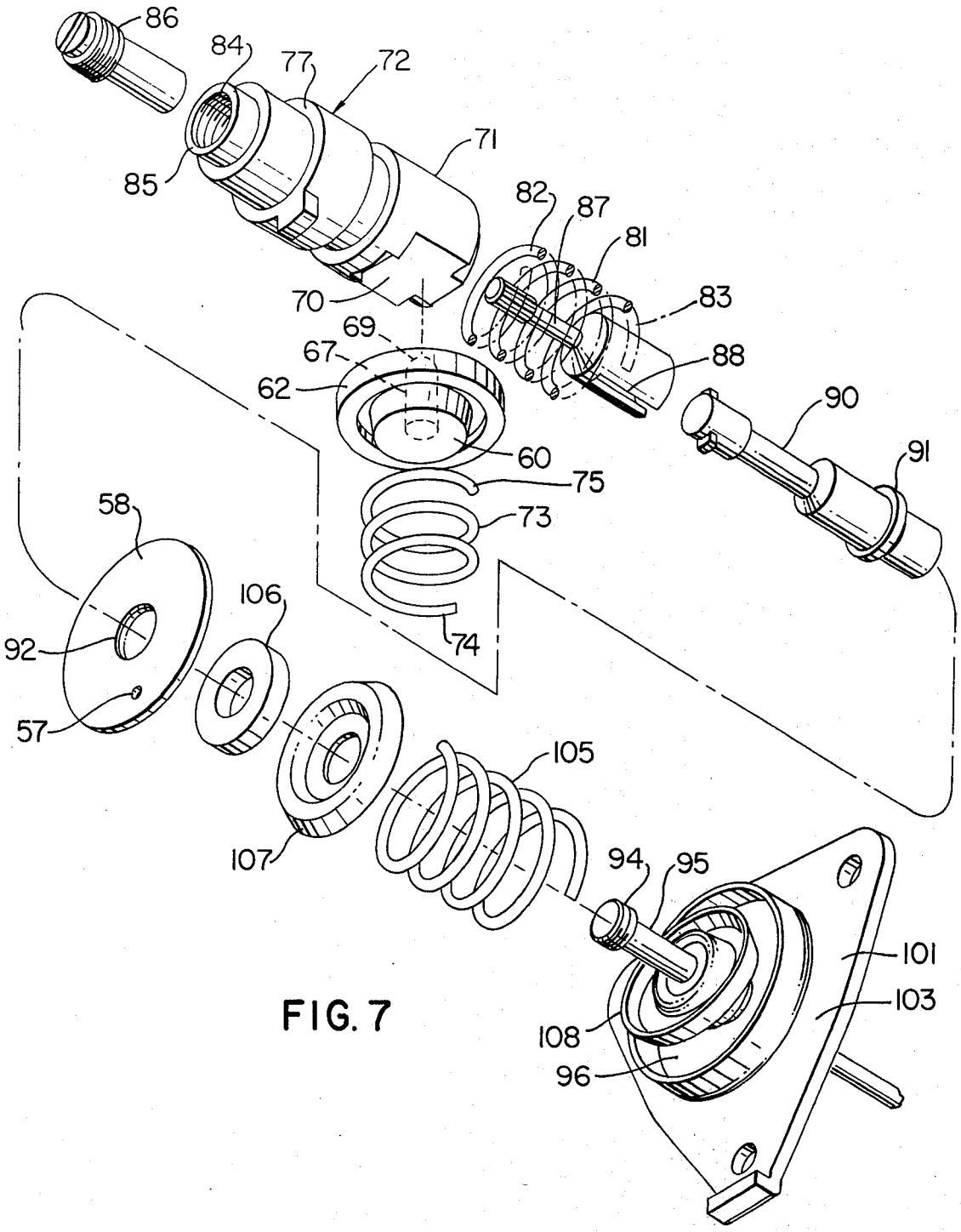
FIG. 7 is an exploded perspective view of certain parts of the fuel control device illustrated in FIG. 1.

Of course, the valve disc 58 will continue to move away from the valve seat 36 to the position illustrated in FIG. 6 should the output temperature effect in the oven 24 not increase to the setting of the knob 76 so that an increased flow of fuel will be provided to the burner means 23 through the thermostatically operated valve means 37.

Thus, the valve disc 58 can thermostatically control the flow of fuel from a minimum amount thereof that will support combustion at the burner means 23 to a full flow of fuel thereof as illustrated in FIG. 6.

The control device 26 is so constructed and arranged that when the selector means 35 is set for a broiling operation, the member 90 has been threaded on the threaded part 94 of the pin 95 such a distance that the power element 54 will not expand sufficiently to cause the valve disc 58 to fully seat against the valve seat 36 during the broiling operation so that a continuous flame broiling operation can be provided by the burner means 23.

When it is desired to turn off the control system 20, the operator rotates the control knob 76 to the off position of the selector means 35 whereby the flat portion of the cam surface 70 of the shaft part 71 is now adjacent the end 69 of the poppet valve member 60 so that the same can be fully seated against the valve seat 63 not only by the force of the compression spring 73, but also by the force of the fuel pressure in the inlet 29 of the control device 26. Also, such rotation of the shaft part 71 to the off position causes the member 90 to be unthreaded from the threaded end 94 of the pin 95 a distance sufficient that the abutment means 91 thereof will not cause the valve disc 58 to open from the valve seat 36 even though the power element 54 would be in a fully collapsed condition thereof by the bulb 56 sensing very low temperatures, such as room temperature.

Because the poppet valve means 34 has a relatively large flexible member 62 engaging the valve seat 63 when the poppet valve member 60 is moved to its closed position, any dirt particles and the like that might be on the valve seat 63 are fully enveloped by the resilient member 62 so that full closure of the seat 63 can take place and no fuel leakage through the valve seat 63 can take place because of such enveloped dirt particles.

Therefore, it can be seen that this invention not only provides an improved fuel control device 26 that has a main on-off poppet valve member that is positively seated by the fuel pressure when in an off condition thereof, but also this invention provides a fuel control system wherein two poppet valve members 60 and 51 are disposed in series relation between the source of fuel 21 and the main burner 23 and both are positively seated by fuel pressure when the same are in the off positions in a manner to tend to prevent any adverse high fuel pressures from escaping out of the system 20 should a malfunction occur in a pressure regulator anywhere in the fuel supply system.

Should it be desired to latch the control shaft of any of the control device of this invention in its off position so that the operator must make an unlatching operation of the control shaft before the control shaft can be moved to an on position thereof, a unique latch means of this invention can be utilized with the control device previously described and such unique latch means is fully illustrated in FIGS. 8–11 and will now be described.

As illustrated in FIGS. 8–11, another fuel control device of this invention is generally indicated by the reference numeral 26F and parts thereof similar to the control device previously described are indicated by like reference numerals followed by the reference letter F.

As illustrated in FIGS. 8–11, the fuel control device 26F includes the housing 28F having the control shaft 71F previously described for controlling the main on-off poppet valve means (not shown in FIGS. 8–11) in the manner previously described.

However, the front casing 79F of the control device 26F is provided with an arcuate, relatively long cam surface 600 on the inside surface thereof, the cam surface 600 having one end 601 provided with a high rapid drop-off to the normal inside surface 602 of the casing member 79F and a tapering end 603 that feathers into the flat surface 602 of the casing member 79F at the other end thereof.

Spaced from the high drop-off point 601 of the cam surface 600 of the casing member 79F is a bent-in stop tang 604 of the casing member 79F that has opposed sides 605 and 606 respectively cooperable with an outwardly directed tang 607 formed on the shaft 71F and extending outwardly form an annular part 611 thereof that is adapted to normally bear against the surface 602 of the casing 79F under the force of the compression spring that acts on the shaft 71F to urge the same to the right in FIGS. 18 and 19, such spring being designated by the reference numeral 81 in FIG. 1 and not being illustrated in FIGS. 8–11.

Figure 8:
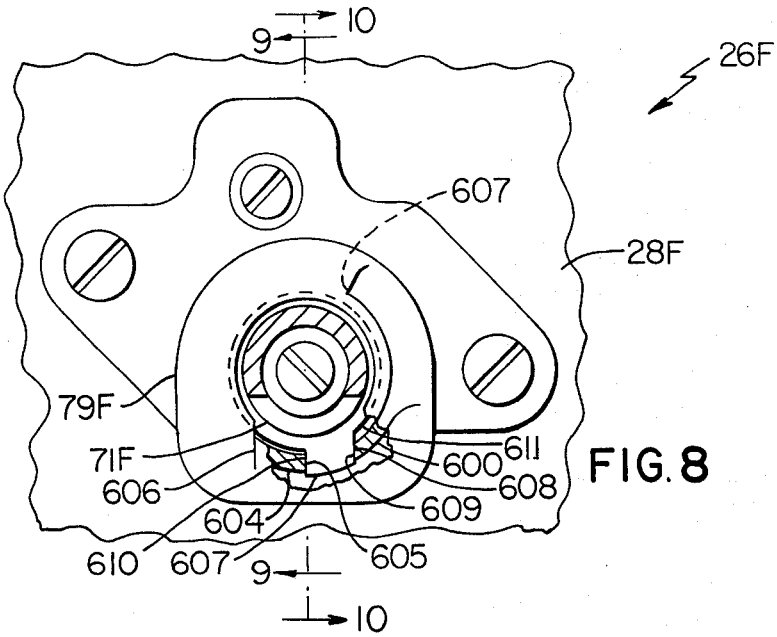
FIG. 8 is a fragmentary front view of another fuel control device of this invention with the control knob there removed and parts thereof broken away.
Figure 9:
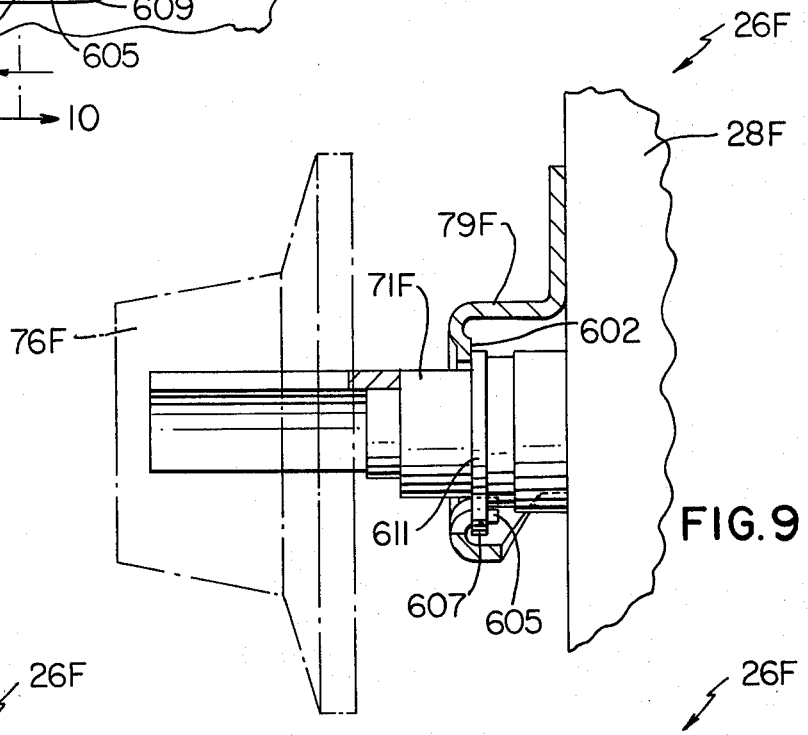
FIG. 9 is a fragmentary, cross-sectional view taken on line 9—9 of FIG. 8.
Figure 10:
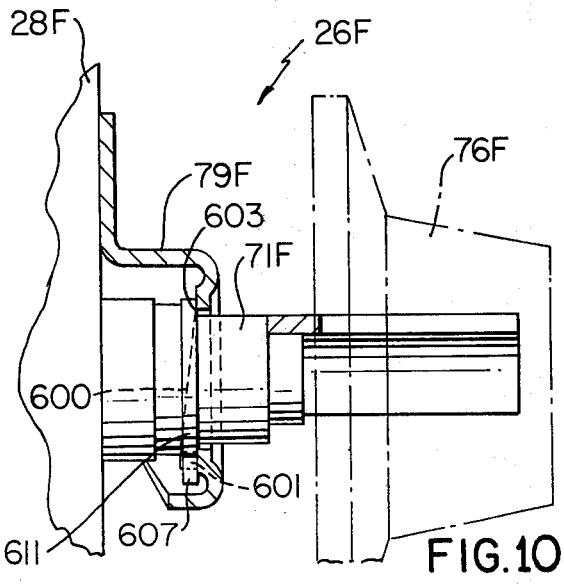
FIG. 10 is a fragmentary, cross-sectional view taken on line 10—10 of FIG. 8.

The tang 607 of the shaft 71F is so constructed and arranged that the same is adapted to be received between the side 605 of the stop tang 604 of the casing member 79F and the drop-off side 601 of the cam surface 600 in the manner illustrated in FIGS. 8, 9 and 10 when the control shaft 71F is disposed in its off position whereby the latch means 607 of the shaft 71F is latched with the latch means 601 of the housing means 28F when the control shaft 71F is disposed in its off position.

With the control shaft 71F disposed in its latched off position as illustrated in FIGS. 8–10, an operator merely grasping the control knob 76F and attempting to rotate the same in an on direction without unlatching the control shaft 71F will be prevented from rotating the shaft 71F in the on direction because the tang 607 will have its side 608 abutting against the side 609 of the drop-off 601 of the cam surface 600 to prevent such rotational movement. Likewise, an attempt to rotate the shaft 76F in a clockwise direction in FIG. 8 from the off position thereof is prevented by the side 610 of the tang 607 of the control shaft 71F abutting against the side 605 of the stop tang 604.

Figure 11:
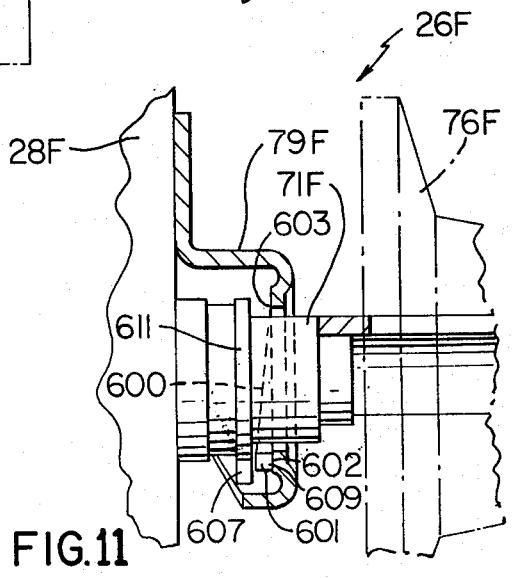
FIG. 11 is a view similar to FIG. 10 and illustrates the contol shaft of the control device of FIG. 10 being moved to its unlatched position.

However, in order to unlatch the control shaft 71F from its off position, the operator merely pushes axially inwardly on the control shaft 71F in opposition to the force of the compression spring tending to hold the shaft 71F in its out condition until the tang 607 on the shaft 71F clears beyond the drop-off point 601 of the cam surface 600 in the manner illustrated in FIG. 11 whereby the shaft 71F is now unlatched from the housing 28F and the control shaft 71F can be rotated in its pushed-in condition from its off position toward any selected on position thereof as the tang 607 will now ride against the cam surface 600 and/or the surface 602 after the shaft 71F is released from its pushed-in condition. In fact, the shaft 71F can be rotated in a counterclockwise direction in FIG. 8 to any desired on position thereof until the tang 607 has the side 608 thereof engage against the side 606 of the stop tang 604 to prevent further rotation in such counterclockwise direction.

When it is desired to turn off the control device 26F, the control shaft 71F is rotated in a clockwise direction in FIG. 8 back to its off position and as the tang 607 of the shaft 71F is rotating against the surface 602 of the casing 79F and comes into engagement with the end 603 of the cam surface 600, such gradual rise of the tang 607 on the cam surface 600 from the end 603 thereof to the end 601 is so gradual that the operator does not have a feel of any particular axial movement of the control knob 67F but once the tang 607 of the shaft 71F clears the drop-off point 601 of the cam surface 600, the tang 607 drops between the side 609 of the cam surface 600 and the side 605 of stop tang 604 in the manner illustrated in FIGS. 9 and 18 under the force of the compression spring acting on the shaft 71F to thereby relatch the control shaft 71F in its off position.

Therefore, it can be seen that in order for the control device 26F to be turned from its off position to its on position, the control shaft 71F must be axially moved toward the housing means 28F and, thereafter, be rotated to the desired position thereof.

Thus, it can be seen that this invention not only provides improved fuel control devices, but also this invention provides a fuel control system utilizing such control devices or the like.

While the forms of the invention now preferred have been described and illustrated as required by the Patent Statute, it is to be understood that other forms may be utilized and still come within the scope of the appended claims.

What is claimed is:

1. In a fuel control system for a fuel burning apparatus or the like having a source of fuel adapted to be interconnected by a passage defining means to main burner means of said apparatus, the improvement comprising a fuel control device disposed in said passage defining means and having poppet valve means that is directly manually operated for opening and closing said passage defining means so as to control the flow of fuel from said source to said main burner means, said control device having a selector means operatively interconnected to said poppet valve means to operate the same between its opened and closed positions, said selector means having latch means for latching said selector means in its off position when said poppet valve means is in its closed position, said control device having latch means cooperable with said latch means of said selector means for latching said selector means in said off position thereof, said selector means being axially movable to clear said latch means of said selector means from said latch means of said control device, said selector means being rotatable in the unlatched condition thereof to operate said poppet valve means, said latch means of said control device comprising a cam surface having a drop-off, said latch means of said selector means comprising a tang that cooperates with said drop-off of said cam surface to latch said selector means in said off position thereof, said cam surface being relatively long and gradual to permit said tang to ride up the same to said drop-off thereof without excessive feel of axial movement of said selector means as said selector means is moved to said off position thereof.

2. A fuel control device having passage defining means for interconnecting a fuel source with a main burner means and having poppet valve means that is directly manually operated for opening and closing said passage defining means so as to control the flow of fuel from said source to said main burner means, said control device having a selector means operatively interconnected to said poppet valve means to operate the same between its opened and closed positions, said selector means having latch means for latching said selector means in its off position when said poppet valve means is in its closed position, said control device having latch means cooperable with said latch means of said selector means for latching said selector means in said off position thereof, said selector means being axially movable to clear said latch means of said selector means from said latch means of said control device, said selector means being rotatable in the unlatched condition thereof to operate said poppet valve means, said latch means of said control device comprising a cam surface having a drop-off, said latch means of said selector means comprising a tang that cooperates with said drop-off of said cam surface to latch said selector means in said off position thereof, said cam surface being relatively long and gradual to permit said tang to ride up the same to said drop-off thereof without excessive feel of axial movement of said selector means as said selector means is moved to said off position thereof.

* * * * *